United States Patent [19]

Bienz

[11] 4,433,498

[45] Feb. 28, 1984

[54] HANGTAG WITH A LINK SERVING AS A FASTENING DEVICE

[75] Inventor: Hans Bienz, Horn, Switzerland

[73] Assignee: Stoffel Seals Corporation, Tuckahoe, N.Y.

[21] Appl. No.: 376,045

[22] Filed: May 7, 1982

[30] Foreign Application Priority Data

May 20, 1981 [CH] Switzerland ..... 3282/81

[51] Int. Cl.[3] ..... G09F 3/00

[52] U.S. Cl. ..... 40/2 R; 40/10 R; 40/15 R; 40/10 D; 40/18; 40/20 R; 24/3 K; 70/459

[58] Field of Search ..... 40/20 R, 18, 19, 15 R, 40/2 R, 10 R, 10 D; 24/14 D, 3 K, 265 H, 240; 70/459, 456 R, 457, 460; D3/61, 62, 63, 64, 65

[56] References Cited

U.S. PATENT DOCUMENTS

| | | | |
|---|---|---|---|
| 627,892 | 6/1899 | Bartel | 24/140 |
| 1,007,634 | 10/1911 | Beavis | 70/457 |
| 2,129,436 | 4/1938 | Murray | 70/459 |
| 2,852,930 | 10/1955 | Thull | 70/459 |
| 3,299,679 | 2/1965 | Anderson | 70/459 |
| 3,513,675 | 5/1968 | Ryder, Jr. et al. | 70/459 |
| 4,024,608 | 5/1977 | Brewer | 24/265 H |
| 4,079,607 | 3/1978 | Spruyt | 70/459 |

FOREIGN PATENT DOCUMENTS

| | | | |
|---|---|---|---|
| 44934 | 2/1982 | European Pat. Off. | 24/3 K |
| 596975 | 11/1925 | France | 70/459 |
| 1248407 | 11/1960 | France | 70/459 |
| 1505852 | 12/1966 | France | 70/459 |
| 2445704 | 8/1980 | France | 70/459 |
| 437306 | 2/1948 | Italy | 70/459 |
| WO82/00751 | 3/1982 | PCT Int'l Appl. | 24/3 K |
| 628223 | 2/1982 | Switzerland | 24/3 K |

*Primary Examiner*—Gene Mancene
*Assistant Examiner*—James Hakomaki
*Attorney, Agent, or Firm*—Dowell & Dowell

[57] ABSTRACT

A key link is developed as an elastic loop (1) that can be turned upward or bent open and is carried by a slide part (3) that can be pushed on the front side into a flat housing (2) until it reaches an arrestable locking position. In the locking position, the free end (4) of the loop (1) that can be bent open is enclosed by the housing (2). For this purpose, the slider (10) that consists of the loop (1) and the slide part (3) has at least one locking latch (6) that can spring out and is intended to reach behind or engaged at least one shoulder (5) provided on the housing (2).

These measures permit a simple and problem-free manufacture of said hangtag, the assembly of which only requires a pushing-together of the parts, where in the pushed-together condition an absolute secure locking of the link is achieved.

12 Claims, 5 Drawing Figures

HANGTAG WITH A LINK SERVING AS A FASTENING DEVICE

This application concerns a hangtag with a link serving as a fastening device which projects from the front side of an inflexible flat housing that at least partially encloses the locking means for the link.

Hangtags of this type are definite mass-produced articles. They serve, for example, as key tags, price tags, identification tags, address tags etc. on clothing, suitcases, briefcases, bags, umbrellas, sports articles, cameras, shoes, etc., where, in each case, the housing as the information carrier carries the marking, identification or other information which is glued, printed, embossed or engraved on the surfaces of the housing.

Special prerequisites in the case of such tags are usefulness and functional reliability with very low manufacturing costs. These requirements are only met to a limited extent by the known hangtags of the above-mentioned type. A known hangtag of this type that is developed as a key tag requires, for example, that the link and the locking spring be inserted before the joining together of the shells of the housing. In addition, the locking spring has a complicated shape and an additional steel bracket is used with a locking recess, which is an additional expense in regard to material as well as manufacturing costs. The application of lettering and/or symbols on the housing surfaces is also expensive.

It is thus the task of the present invention to create a hangtag of the above-mentioned type that, while avoiding the disadvantages of the known hangtags, can be manufactured easily and inexpensively, functions in an optimal manner and has few exchangeable parts.

In the case of the hangtag according to the invention, this is achieved by the fact that the link is developed as an elastic loop that can be turned upward or bent open, with the link being shaped onto a slide part which, on the front side, can be pushed into the housing into an arrestable locking position, where in the locking position the free end of the loop that can be turned upward is enclosed by the housing.

These measures permit a simple, problem-free manufacture of such a hangtag, the assembly of which, in addition, only requires a pushing-together of the parts, where in the pushed-together condition, the locking of the link is absolutely secure.

An advantage of the hangtag according to the invention is that the slider which consists of a loop member and a slide member also includes a locking or latch member which is intended for engaging at least one shoulder provided on the housing. The locking or latching member is located on the free end of the resilient arm formed on the slide member and, in locking position, extends at least partially through an opening in the housing, whereby the locking or latching member is urged into the opening, but can be pressed into the housing for unlocking the locking or latching member from the housing.

Advantageously, the locking latch in the locking position, extends through an opening at a corner of the front side of the housing that faces away from the loop, and the housing at this point has a lateral recess that is used for the manual operation of the locking latch.

It is especially advantageous to develop the hangtag according to the invention in such a way that the slider that can be pushed in and consists of the loop and the slide part can be locked in an intermediate position that permits the opening of the loop by means of the fact that, for example, the locking latch in the intermediate position snaps into another opening in the housing. Here it is advantageous that the locking latch has an inclined surface for the automatic pressing-in of the locking latch when the slider is slid from the intermediate position into the locking position.

In the intermediate position, the loop is opened and the hangtag can be attached or detached to or from an object. The intermediate locking feature protects against the undesirable complete separation of the two major parts of the hangtag.

Another especially advantageous development consists of the fact that the housing and the slider may be made of plastic material with at least the housing being made of transparent plastic. A label suitable for displaying written or printed indicia may also be provided which is formed in a U-shaped manner and which extends into the housing with portions of the U-shaped label extending on both sides of the tongue or slider in such a manner that the tongue or slider prevents the label from being separated from the housing when the slider is in locked position with the housing. The label may also be provided with a cutout at one edge in order not to impair the manual operation of the latch member.

Such a development has the advantage that the label must only have printing or writing on one side, where in the hangtag, after the folding of the label, the hangtag carries information on both sides. In addition, the label is protected by the housing so that it cannot be lost and the writing cannot be rubbed off. The information on the label may be used for the identification (in regard to origin, warranty, directions) of the merchandise that is provided with the hangtag. Because of the easy interchangeability of the label, the same hangtag, provided with a new label, can later carry out a second function as identifying means, for example, address tag, key tag, for the user of the merchandise.

Embodiments of the object of the invention, used as examples are explained in detail by means of the drawing as follows.

Figure 1:
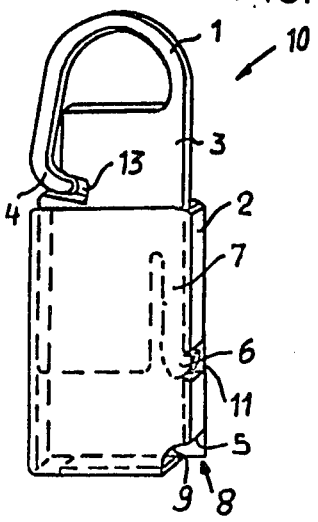
FIG. 1 shows a diagram of a hangtag in open position.
Figure 4:
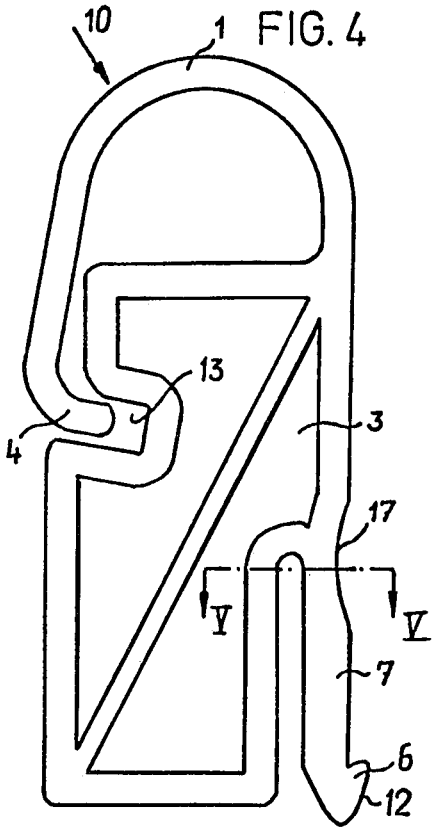
Figure 2:
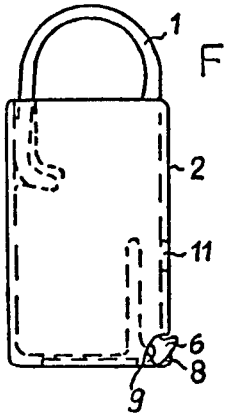
FIG. 2 shows a hangtag according to FIG. 1 in closed condition.
Figure 3:
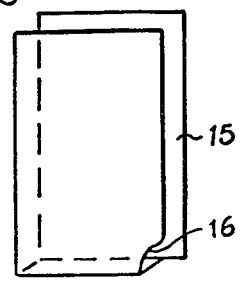
Figure 5:
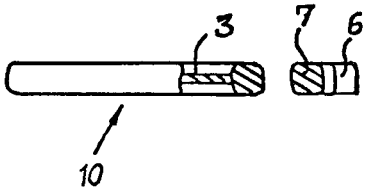

FIG. 3 shows the label that can be inserted in the hangtag according to FIGS. 1 and 2; and FIGS. 4 and 5 show a lateral view and a cross section of the slider of the hangtag that can be slid into the housing, according to FIGS. 1 and 2, at a larger scale.

The hangtag as shown in the figures, for example, may be used as a key tag, and has a link or an elastic loop 1 that can be bent upward or bent open, and which projects from a flat slide part 3.

In the shown embodiment, the free end 4 of the loop 1 is bent inward and is inserted in a recess 13 of the tongue 3. In the pushed-in position of the slider 10 in the housing 2, according to FIG. 2, the loop 1 can no longer be opened.

In this pushed-in position, which is the locking position, a locking latch 6, extends behind a shoulder 5 at the housing 2. This locking latch 6 is located of the free end of an elastic arm 7 formed with the slide part 3 and extends at least partially through an opening 8 in a corner of the front side of the housing 2 that faces away from the loop 1. At this point, the housing 2 also has a lateral recess 9 in order to facilitate a pressing-inward of the locking latch 6, when the hangtag is to be opened by pushing the slider 10 out of the housing 2.

Since it is not necessary to completely push the slider 10 out of the housing 2 for a brief opening of the key tag, an intermediate position is provided in which the slider 10 can be locked intermediately in the housing 2. For this purpose, the locking latch 6 engages in another opening 11 in the housing 2. Here an inclined surface 12 for the automatic pressing-in of the locking latch 6 when sliding the slider 10 from the intermediate position into the locking position is provided on the locking latch 6.

As can be easily recognized, a hangtag is created in this manner that is extremely easy to manufacture, especially a key tag, which also guarantees a secure locking of the key link.

Within the framework of the invention, a number of modifications and supplements are possible.

For example, the free end 4 of the loop 1 itself may carry the locking latch which then, in the cased of a pushed-in slide part 3, would engage in a corresponding recess at the housing 2 without any changes in regard to the secure locking of the loop 1.

In addition, it is conceivable to provide at the lower part of the slide part 3 on each side, a locking latch that can be pressed in, on an elastic arm.

In addition to the rectangular shape shown here, the housing 2 and correspondingly also the slide part 3 may also have a different geometrical shape.

Also, the slider 10 consisting of the loop 1 and the slide part 3 may be a pressed piece or a stamping of a flat shape as can be recognized approximately on the basis of FIG. 1. However, according to FIGS. 4 and 5, this slider 10 may also be a sprayed die casting having a rib-shaped development. Here it can be recognized that a flute 17 at the root of the elastic arm 7 improves its spring characteristics.

The slider 10 that can be pushed in and the housing 2 consist preferably of plastic, where advantageously at least the housing 2 is transparent in order to be able to slide in labels that are visible behind the housing surfaces.

In the case of the hangtag according to the invention, a label 15 is provided according to FIG. 3 that is made of a material for writing and/or printing upon, which is folded in a U-shaped manner and extends in the housing 2 with its arms on both sides of the slide part 3. Here, in the area of the recess 9 of the housing 2, a cutout 16 is provided in order not to impair the engaging of the locking latch 6.

The advantage of this label arrangement is first that independently from the neutrally produced hangtag, the label can be lettered individually, perhaps by the purchaser. In addition, this label 15, inserted into the housing 2, without additional measures, is protected from falling out, since the label, when the slide part 3 is pulled out into the intermediate position, can only follow the slide part 3 at best as far as that.

As is easily recognized, all parts of the hangtag are designed so that they can be exchanged without difficulty. When it is desired to remove the slider 10 and label 15 from the housing 2, the locking latch 6 engaged in the intermediate position in the opening 11 is simply pressed in and the slider 10 pulled free of the housing.

Thus a hangtag was created according to the above that meets all requirements in regard to simplicity in concept while taking into consideration the criteria of a mass-produced article with absolute functional reliability and a large range of application.

I claim:

1. A hangtag for use as a fastening device comprising a generally flat housing having front and back portions and first and second ends, a slide means selectively receivable within said housing, said slide means having first and second end portions, a resilient loop member extending from said first end portion of said slide means, said loop member having a free end which is selectively receivable within said housing when said slide means is inserted into said first end of said housing, a first opening through said housing spaced from said first end thereof, locking means carried by said slide means and having a latching portion, a second opening in said housing, said second opening being located between said first end of said housing and said first opening, said latching portion of said locking means being at least partially and selectively receivable within said first and second openings when said slide means is inserted into said housing, said free end of said loop means being retained within said housing when said latching portion of said locking means is received within said first opening and being in nonengaging relationship with said housing when said latching portion of said locking means is received within said second opening.

2. The hangtag of claim 1 including a recess provided in said slide means, said free end of said loop means being retained within said recess of said slide means when said slide means is inserted into said housing.

3. The hangtag of claim 2 in which said free end of said loop means is positioned between said first end of said housing and said second opening when said free end of said loop means is retained within said recess of said slide means.

4. The hangtag of claim 1 in which said first opening is provided at a corner of said second end of said housing so as to be remote from said loop means.

5. The hangtag of claim 4 in which said first opening includes a recess in said front portion of said housing whereby said latching means may be manually urged into said housing.

6. The hangtag of claim 5 including a label means, said label means being generally U-shaped and having parallel side portions connected by an intermediate portion, said label means being slidably carried within said housing with said intermediate portion thereof disposed adjacent said second end of said housing and said side wall portions thereof extending on opposite sides of said slide means toward said first end of said housing, said label means having a recess formed in a portion thereof so as to overlay the recess formed in said front portion of said housing when said label means is carried within said housing.

7. The hangtag of one of claims 1 through 6 in which said slide means includes a body portion, said locking means having a resilient arm portion integrally formed with said body portion of said slide means and being spaced from and extending generally longitudinally with respect to said body portion of said slide means, said arm portion being bendable along its length toward the body portion of said slide means, and said latch means including an outwardly flared wall portion defining hook means for engaging said housing when said latch means is urged through said first or second opening.

8. The hangtag of one of claims 1 through 5 including label means, said label means being generally U-shaped and having parallel side portions connected by an intermediate portion, said label means being slidably carried within said housing with said intermediate portion thereof disposed adjacent said second end of said housing and said side wall portions thereof extending on opposite sides of said slide means toward said first end of said housing.

9. A hangtag for use as a fastening device comprising a generally flat housing having front and back portions and first and second ends, a slide means selectively receivable within said housing, said slide means having first and second end portions, a resilient loop member extending from said first end portion of said slide means, said loop member having a free end which is selectively receivable within said housing when said slide means is inserted into said first end of said housing, a first opening through said housing spaced from said first end thereof, locking means carried by said slide means and having a latching portion, said latching portion of said locking means being at least partially receivable within said opening when said slide means in inserted into said housing, a recess provided in said slide means, said free end of said loop means being retained within said recess of said slide means when said slide means is inserted into said housing, said slide means having a body portion, said locking means having a resilient arm portion integrally formed with said body portion of said slide means and being spaced from an extending generally longitudinally with respect to said body portion of said slide means, said arm portion being bendable along its length toward the body portion of said slide means whereby when said latching portion of said locking means is received within said opening said free end of said loop means will be retained within said housing.

10. The hangtag of claim 9 including label means, said label means being generally U-shaped and having parallel side portions connected by intermediate portion, said label means being slidably carried within said housing with said intermediate portion thereof disposed adjacent said second end of said housing and said side wall portions thereof extending on opposite sides of said slide means toward said first end of said housing.

11. A hangtag for use as a fastening device comprising a generally flat housing having front and back portions and first and second ends, a slide means selectively receivable within said housing, said slide means having first and second end portions, a resilient loop member extending from said first end portion of said slide means, said loop member having a free end which is selectively receivable within said housing when said slide means is inserted into said first end of said housing, a first opening through said housing spaced from said first end thereof, locking means carried by said slide means and having a latching portion, said latching portion of said locking means being at least partially receivable within said opening when said slide means is inserted into said housing, a recess provided in said slide means, said free end of said loop means being retained within said recess of said slide means when said slide means is inserted into said housing, said first opening being provided at a corner of said second end of said housing so as to be remote from said loop means, label means, said label means being generally U-shaped and having parallel side portions connected by intermediate portion, said label means being slidably carried within said housing with said intermediate portion thereof disposed adjacent said second end of said housing and said side wall portions thereof extending on opposite sides of said slide means toward said first end of said housing.

12. The hangtag of claim 11 including a second opening in said housing, said second opening being located between said first end of said housing and said first opening, said latching portions of said locking means being selectively receivable within said second opening.

* * * * *